US008794455B2

(12) United States Patent
Yang et al.

(10) Patent No.: US 8,794,455 B2
(45) Date of Patent: Aug. 5, 2014

(54) DISH RACK

(75) Inventors: Frank Yang, Rancho Palos Verdes, CA (US); Tzu-Hao Wei, Hacienda Heights, CA (US); Myk Lum, Irvine, CA (US); Adam Wade, Rancho Santa Margarita, CA (US); Joseph Sandor, Santa Ana Heights, CA (US)

(73) Assignee: Simplehuman LLC, Torrance, CA (US)

( * ) Notice: Subject to any disclaimer, the term of this patent is extended or adjusted under 35 U.S.C. 154(b) by 0 days.

(21) Appl. No.: 12/322,350

(22) Filed: Jan. 29, 2009

(65) Prior Publication Data

US 2009/0211994 A1 Aug. 27, 2009

Related U.S. Application Data

(63) Continuation-in-part of application No. 29/301,789, filed on Mar. 14, 2008, now Pat. No. Des. 599,067.

(60) Provisional application No. 61/062,885, filed on Jan. 29, 2008.

(51) Int. Cl.
*A47G 19/08* (2006.01)

(52) U.S. Cl.
USPC ..... 211/41.3; 211/41.4

(58) Field of Classification Search
USPC ..... 211/41.8, 184, 41.3–41.9, 85.25; 220/529; 5/515–523, 656; 248/213.2
See application file for complete search history.

(56) References Cited

U.S. PATENT DOCUMENTS 1,742,150 A 12/1929 Rollins
1,789,232 A * 1/1931 Hertz ..... 211/41.3
2,864,509 A * 12/1958 Watral ..... 211/41.4
3,050,073 A * 8/1962 McMillan ..... 134/137
3,927,703 A * 12/1975 Beaubien ..... 141/333
4,046,261 A * 9/1977 Yake ..... 211/41.8
4,531,641 A * 7/1985 Archambault ..... 211/41.3
4,854,537 A * 8/1989 Welch ..... 248/346.5
4,927,033 A * 5/1990 Patera et al. ..... 211/41.9
5,119,943 A * 6/1992 Hoang ..... 211/41.3
5,249,590 A * 10/1993 Jacobus et al. ..... 134/135
5,704,492 A * 1/1998 Bartko ..... 211/41.3
6,125,548 A * 10/2000 Dunn et al. ..... 34/104
6,179,134 B1 1/2001 Pine et al.

(Continued)

FOREIGN PATENT DOCUMENTS

DE 706307 5/1941

OTHER PUBLICATIONS

Partial International Search Report of Counterpart PCT Application No. PCT/US2009/000600.

*Primary Examiner* — Korie H Chan
(74) *Attorney, Agent, or Firm* — Liu & Liu

(57) ABSTRACT

An extendable drip tray is provided to increase when needed the drip catchment area of the dish rack, to beyond the footprint or general perimeter of the dish rack. The extendable drip tray may be slidably supported by rails below the main body of the dish rack, to cover an area beyond the side of the dish rack body, thereby increasing the drip catchment area. Pivoted cup holders are provided along the outside walls of the main body of the dish rack, which can be pivoted when needed to extend an area beyond the perimeter of the body to provide supports for holding kitchen articles such as cups and glasses for drying. A wire rack is provided with pivoted support prongs for configuring the wire rack.

17 Claims, 20 Drawing Sheets

(56) References Cited

U.S. PATENT DOCUMENTS

| | | | | |
|---|---|---|---|---|
| 6,848,585 | B2 * | 2/2005 | VanLandingham | 211/41.9 |
| 7,228,975 | B2 * | 6/2007 | Yang et al. | 211/41.4 |
| 7,458,470 | B2 * | 12/2008 | Jerstroem et al. | 211/41.4 |
| 7,748,543 | B2 * | 7/2010 | Yang et al. | 211/41.3 |
| 2006/0237379 | A1 * | 10/2006 | Yang et al. | 211/41.4 |
| 2006/0283817 | A1 * | 12/2006 | Yang et al. | 211/41.4 |
| 2008/0083678 | A1 * | 4/2008 | Graute | 211/41.8 |
| 2008/0302740 | A1 * | 12/2008 | Moser et al. | 211/41.8 |

* cited by examiner

DISH RACK

CROSS REFERENCE

This application claims priority of U.S. Provisional Patent Application No. 61/062,885, entitled "High End Dish Rack", filed on Jan. 29, 2008, and a Continuation-in-part of U.S. Design Patent Application No. 29/301,789, entitled "Dish Rack", filed on Mar. 14, 2008. This application and other applications and documents referenced herein are fully incorporated by reference as if fully set forth herein.

FIELD OF THE INVENTION

The present invention relates to dish racks.

BACKGROUND OF THE INVENTION

Dish racks are kitchen organizers designed for holding kitchen articles, such as cups, dishes, plates, cutlery, and other utensils for drying. A dish rack typically includes a body with a structure for supporting the articles in an organized manner for drying, and a catchment platform for catching water drips from the articles.

Heretofore, dish racks have been developed with various structural features to enhance functionalities of dish racks. For example, U.S. design patent application nos.: 29/293,402 and 29/301,789; U.S. utility application Ser. Nos.: 11/026,254; 11/601,441; 11/113,898; 11/157,302; 11/811,167; 11/899,440 and 11/201,802 disclose various features desirable for dish racks. Some of the disclosed features are configurable by the user to provide flexible options to the users.

It is desirable to design an improved configurable dish rack to provide further improved functionalities for organizing and supporting kitchen articles for drying, which are not found in the earlier applications, and further with improved aesthetics.

SUMMARY OF THE INVENTION

The invention is directed to a dish rack that includes structures for improved functionalities and aesthetics. In one aspect of the present invention, an extendable drip tray is provided to increase when needed the drip catchment area of the dish rack, to beyond the footprint or general perimeter of the dish rack. The extendable drip tray may be slidably supported by rails below the main body of the dish rack, to cover an area beyond the side of the dish rack body, thereby increasing the drip catchment area. In another aspect of the present invention, pivoted attachments are provided along the outside walls of the main body of the dish rack, which can be pivoted when needed to extend an area beyond the perimeter of the body to provide supports for holding kitchen articles such as cups and glasses for drying. In one embodiment, the attachment is a cup holder. The drip tray can be extended to catch water drips from the extended cup holding area. In a further aspect of the present invention, within the body of the dish rack, a wire rack, which may be removable or detachable, is provided with pivoted support prongs for configuring the wire rack. In yet a further aspect of the present invention, the main body of the dish rack is configured with a substantially continuous metal wall that defines the perimeter or footprint of the dish rack, and the internal drip area, which improves ease of cleaning the body as well as the aesthetics of the dish rack. To facilitate support of the pivot mechanism for the pivotable cup holders, a base is provided which is made of another material, such as plastic, to facilitate attachment of the cup holders to the metal wall. The plastic base also facilitates support and coupling of metal legs and other components to the metal body of the dish rack.

BRIEF DESCRIPTION OF THE DRAWINGS

For a fuller understanding of the nature and advantages of the invention, as well as the preferred mode of use, reference should be made to the following detailed description read in conjunction with the accompanying drawings. In the following drawings, like reference numerals designate like or similar parts throughout the drawings.

DETAILED DESCRIPTION OF THE PREFERRED EMBODIMENTS

The present description is of the best presently contemplated mode of carrying out the invention. This description is made for the purpose of illustrating the general principles of the invention and should not be taken in a limiting sense. The scope of the invention is best determined by reference to the appended claims. The invention has been described herein in reference to various embodiments and drawings. It will be appreciated by those skilled in the art that variations and improvements may be accomplished in view of these teachings without deviating from the scope and spirit of the invention.

By way of illustration, various aspects of the present invention will be described in reference to a dish rack having a wire rack within a main body, for supporting kitchen articles such as cups, dishes, plates, cutlery, and other cooking utensils. Other types of dish racks (e.g., a dish rack having a wire frame body) may take advantage of certain of the novel features of the present invention.

Figure 1:
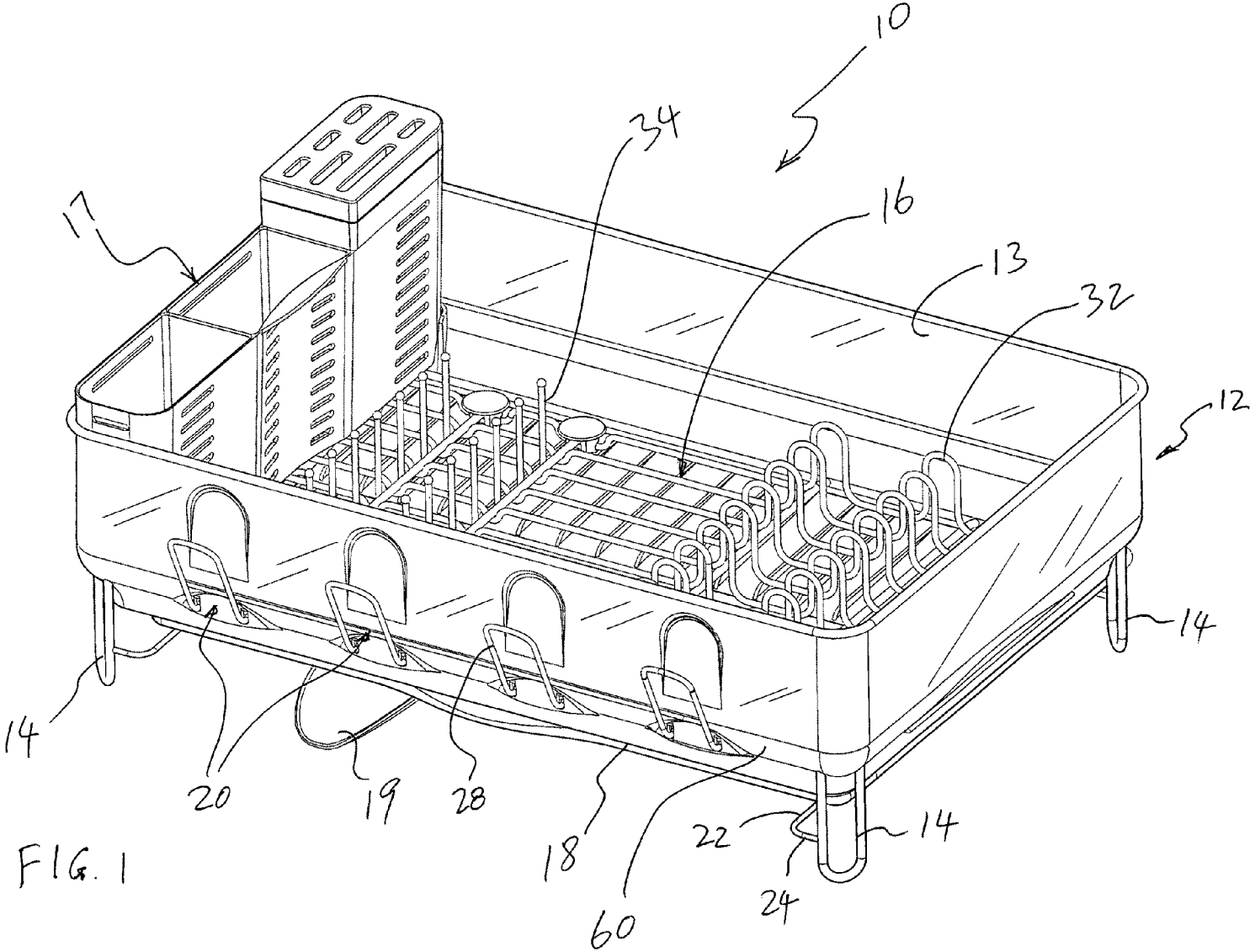
FIG. 1 is a perspective view of a dish rack, in accordance with one embodiment of the present invention.
Figure 2:
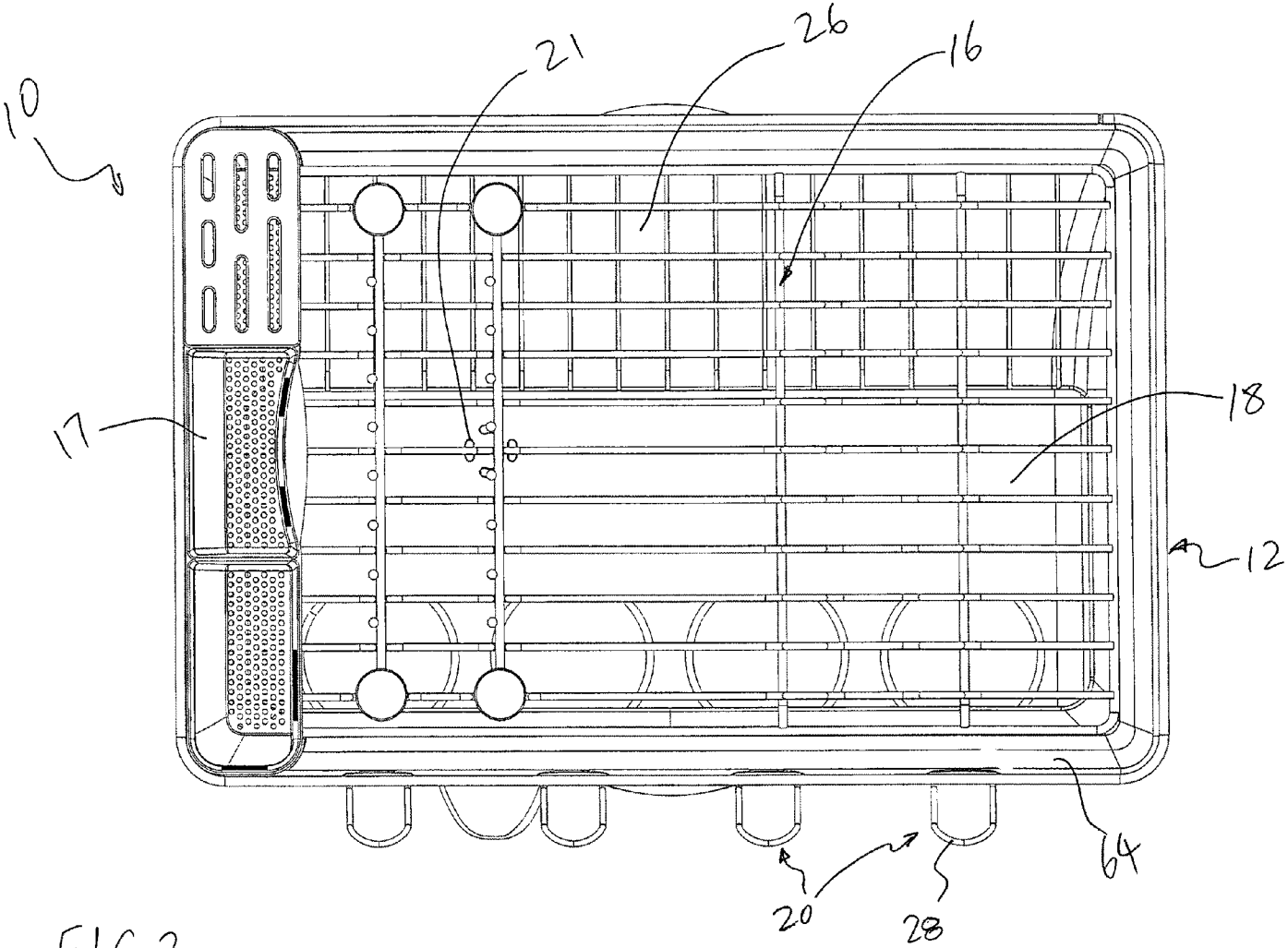
FIG. 2 is a top view of the dish rack in FIG. 1.
Figure 3:
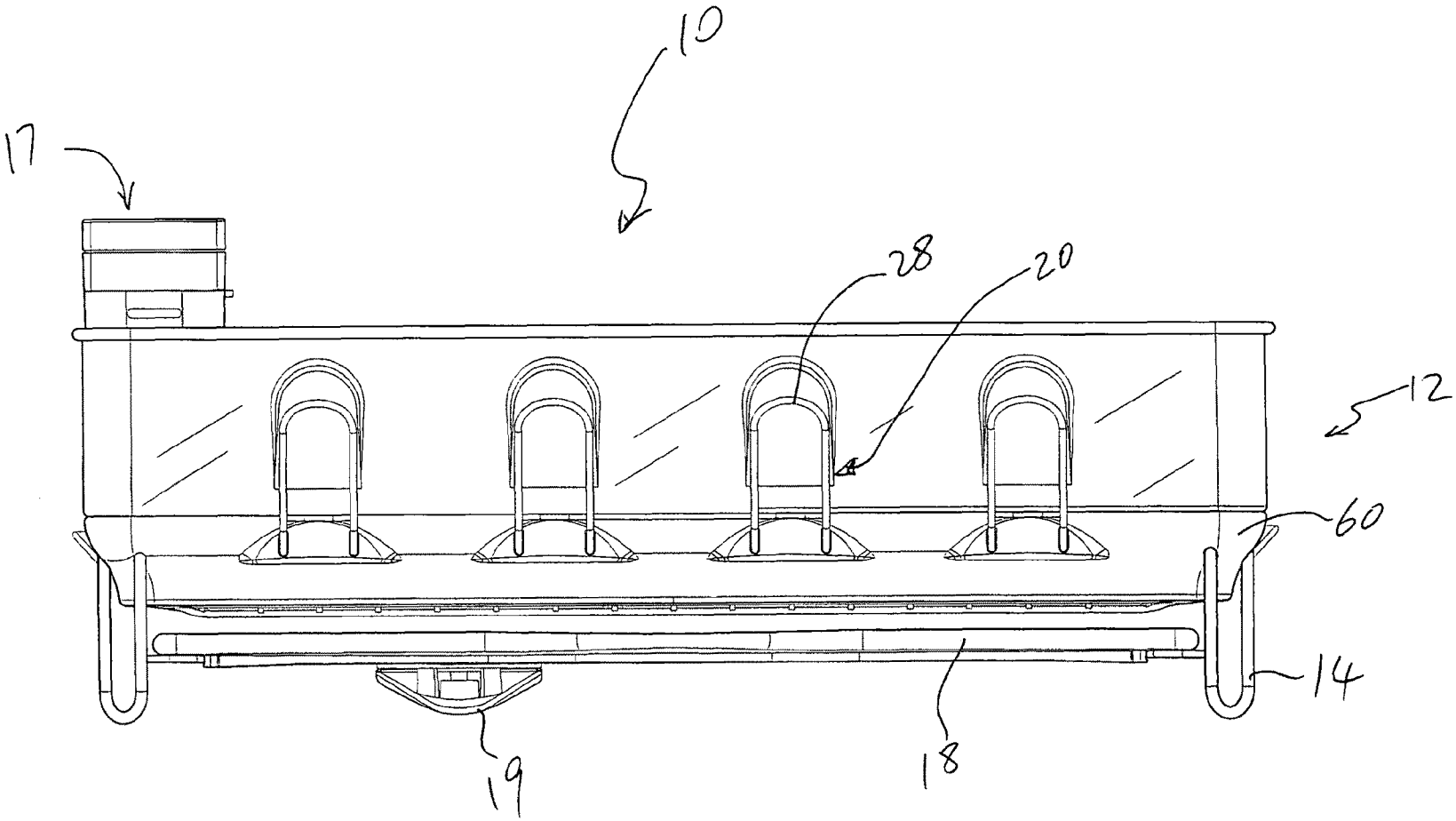
FIG. 3 is a front view of the dish rack in FIG. 1.
Figure 4:
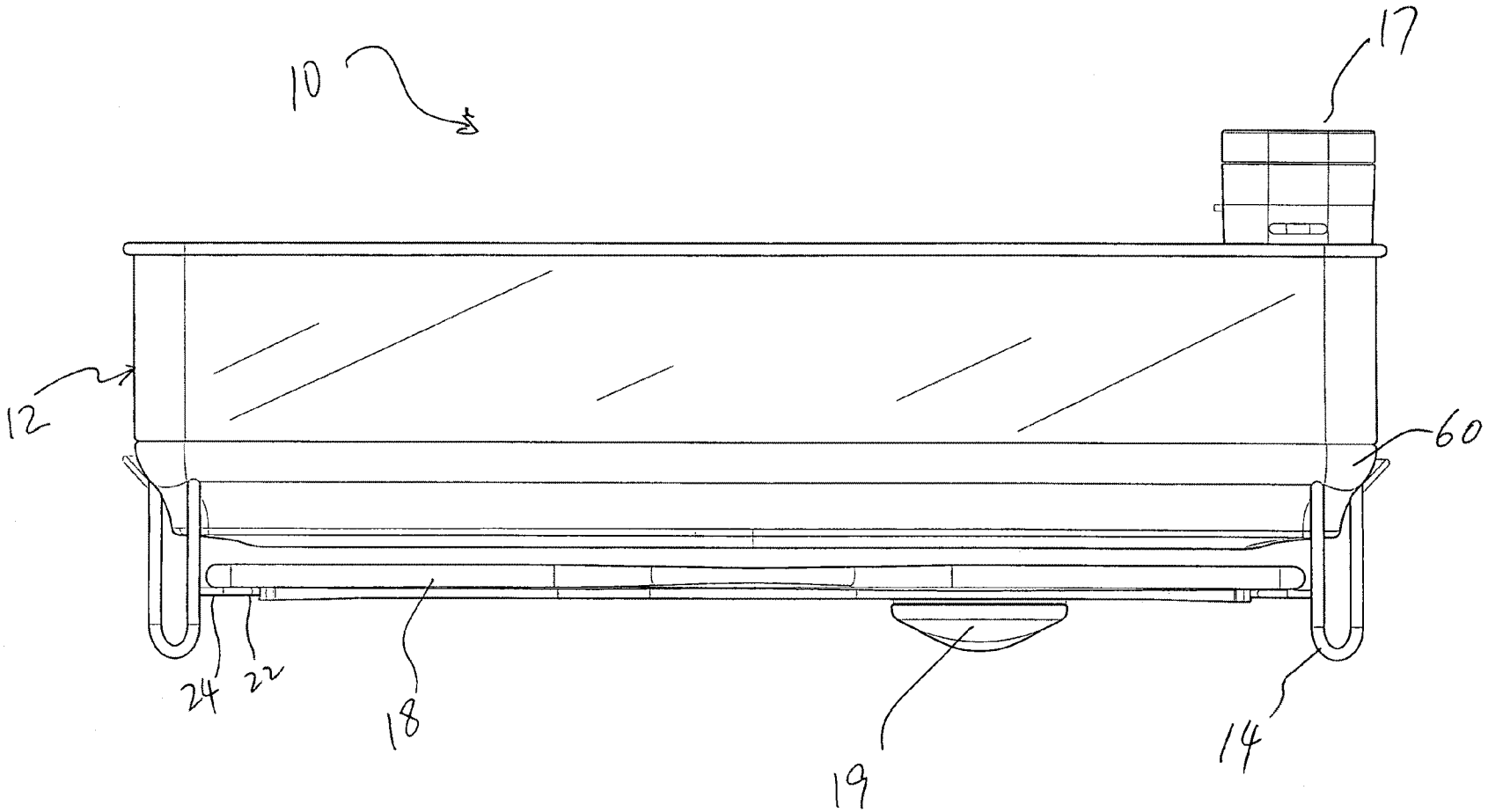
FIG. 4 is a rear view of the dish rack in FIG. 1.
Figure 5:
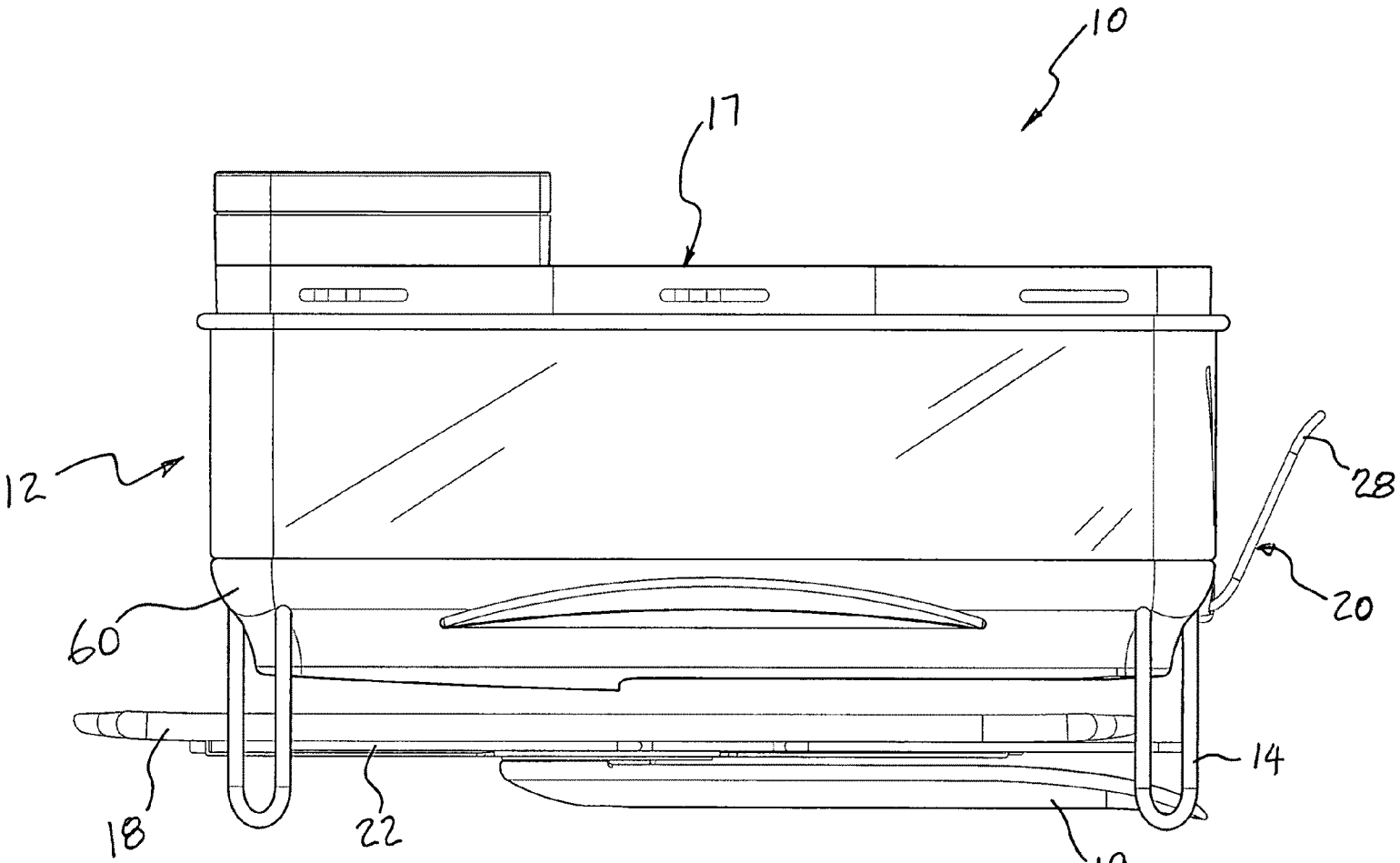
FIG. 5 is a side view of the dish rack in FIG. 1.
Figure 6:
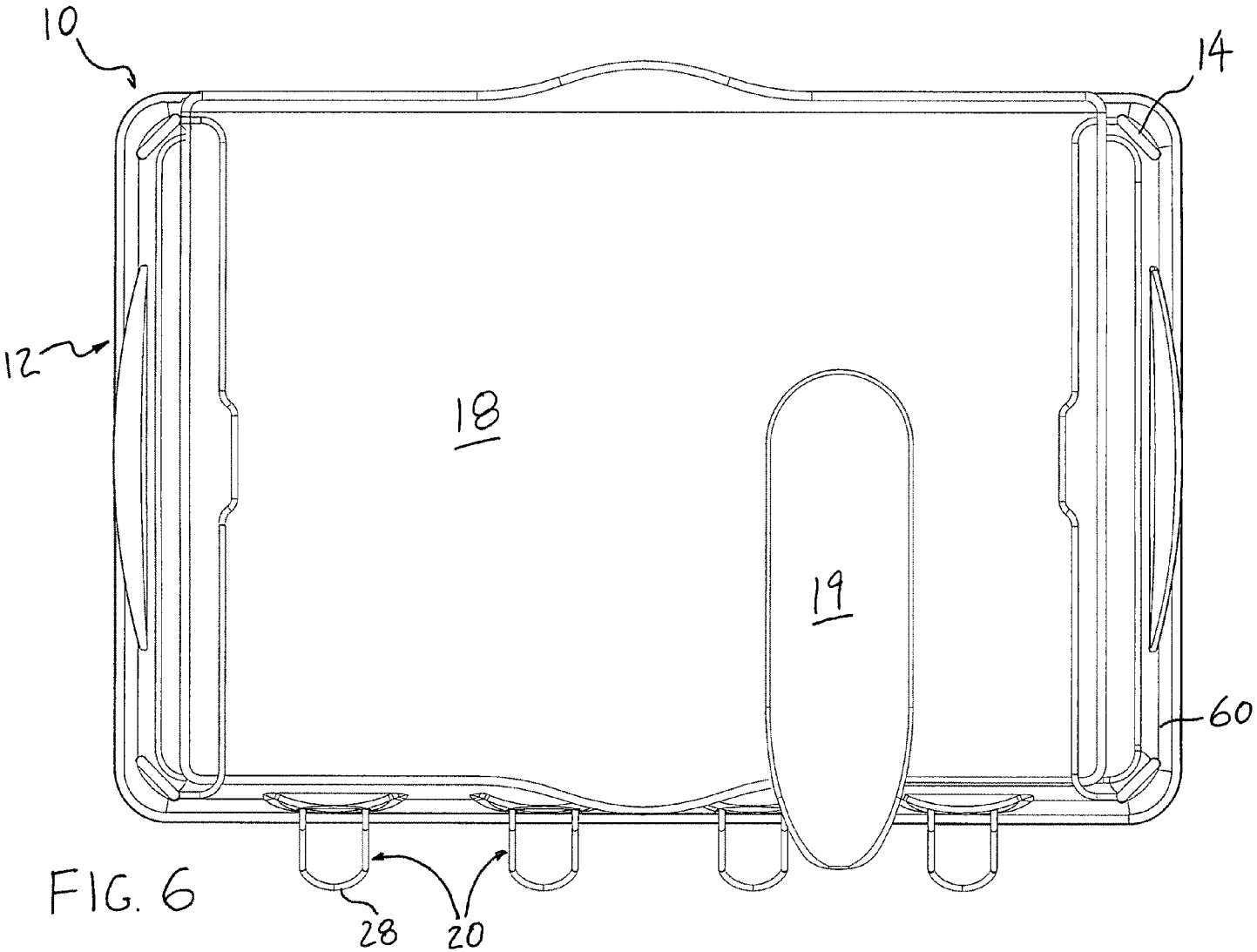
FIG. 6 is a bottom view of the dish rack in FIG. 1.

FIGS. 1 to 6 illustrate a dish rack in accordance with one embodiment of the present invention. The dish rack 10 includes a main body 12. The body 12 has walls 13 defining the footprint or general perimeter of the dish rack 10. The walls also define the regular drip area of the dish rack. Water dripping from the kitchen articles is caught and diverted by a drip tray 18 spaced below the drip area, below the walls 13 and a wire rack 16. The drip area defined by the walls 13 is not closed at the bottom, comprising an opening exposing an underlying drip tray 18, allowing water to drip onto the underlying drip tray 18. Legs 14 extend below the body 12. The wire rack 16 is held within the walls 13 of the body 12, extending to cover the entire drip area. In the illustrated embodiment, a removable accessory tray 17 is provided at one side of the drip area, which may include a knife block and baskets for holding items such as silverware. The drip tray 18 is slidably supported on rails below the body, which is sized to extend to provide coverage to catch water drips from the entire drip area. The tray 18 may include a drainage spout 19, which may be rotatable for directing water drainage to a desired direction with respect to the sides of the body 12. Cup holders 20 are pivotally supported along at least one side wall 13 of the body 12. In FIG. 1, the cup holders 20 are pivoted in the outward, extended position.

Figure 7:
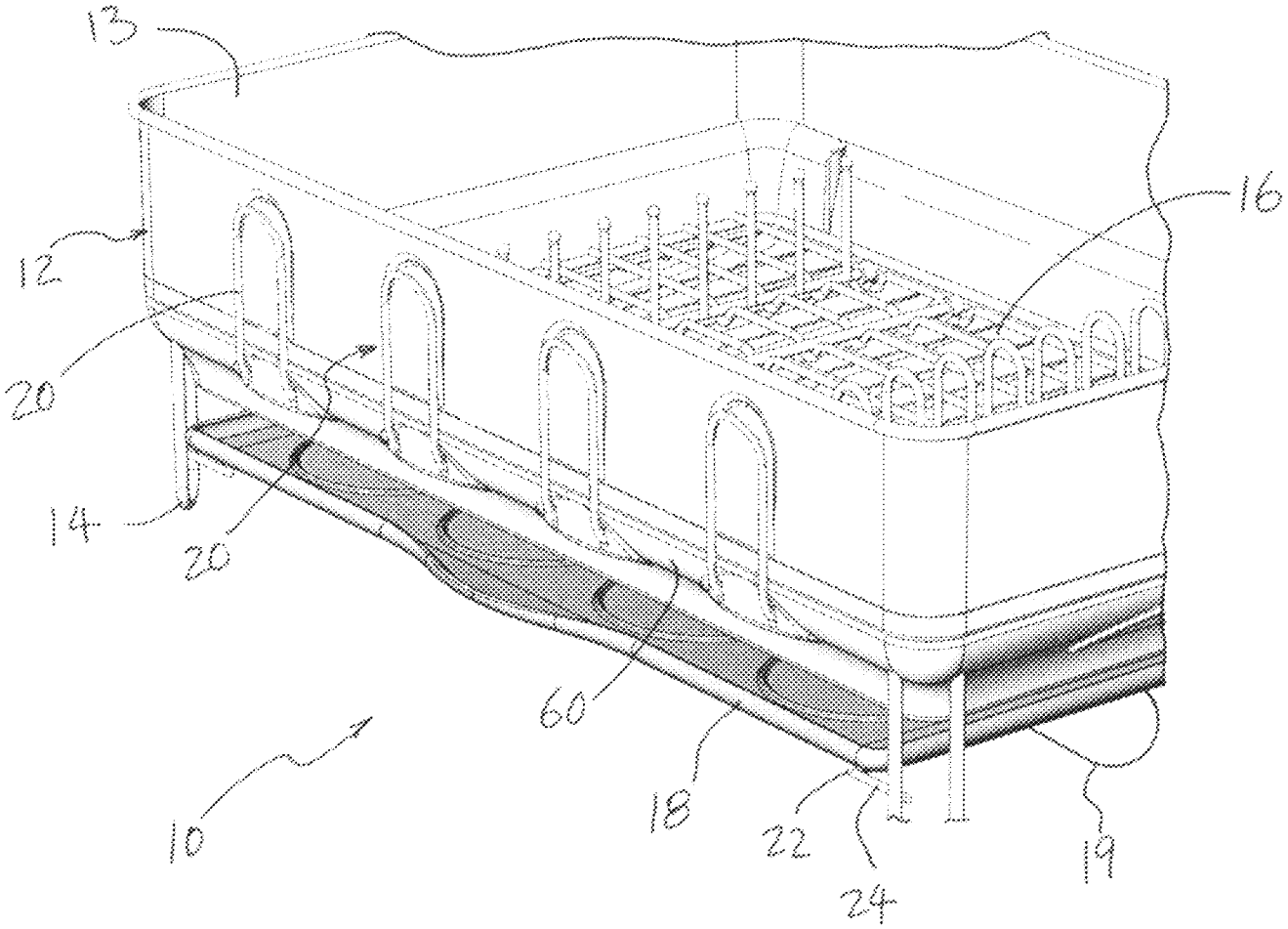
FIG. 7 is a perspective view of a dish rack in accordance with another embodiment of the present invention, with the slidable drip tray in the retracted position.
Figure 8:
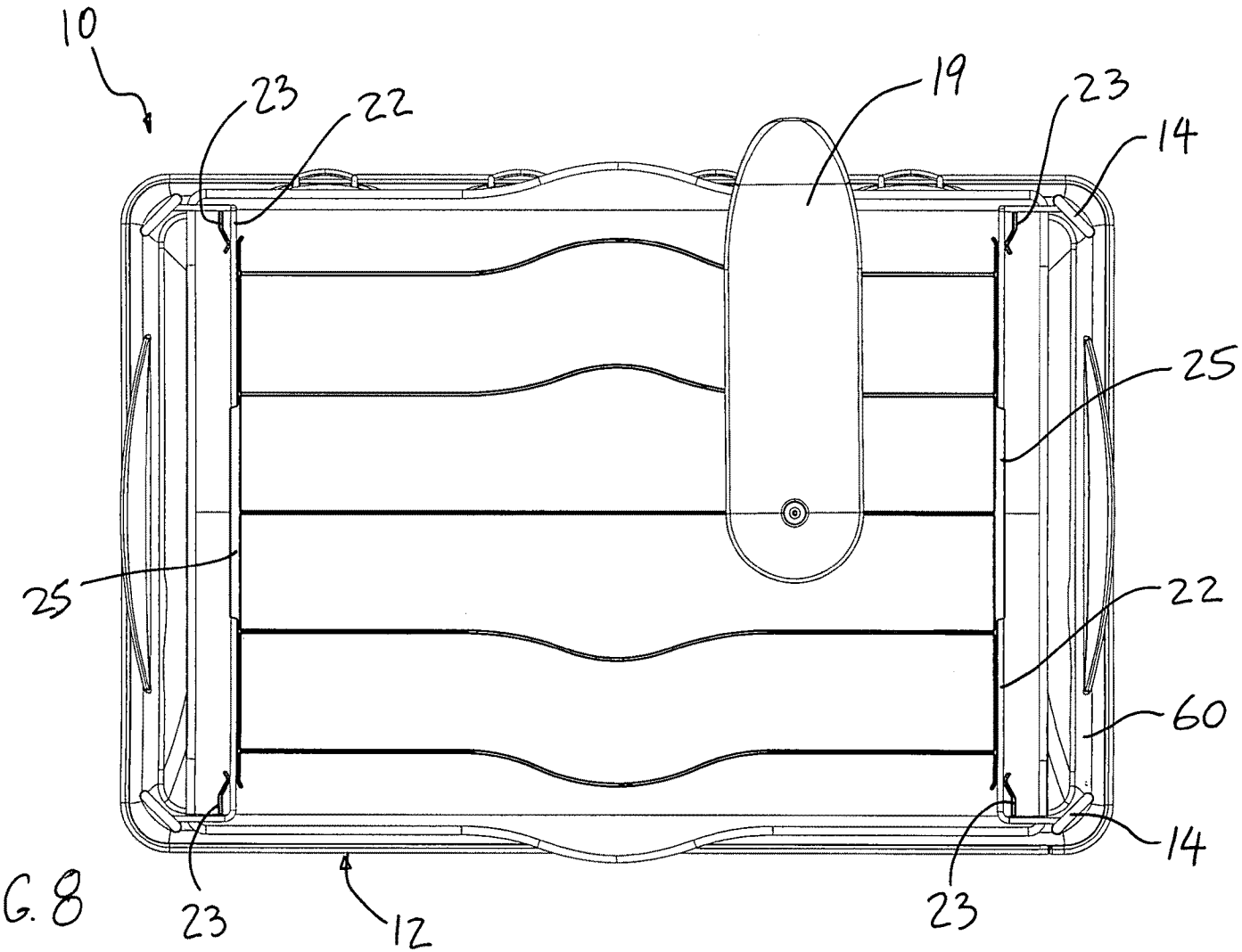
FIG. 8 is a bottom view of the dish rack in FIG. 7, with the slidable drip tray in the retracted position.
Figure 9:
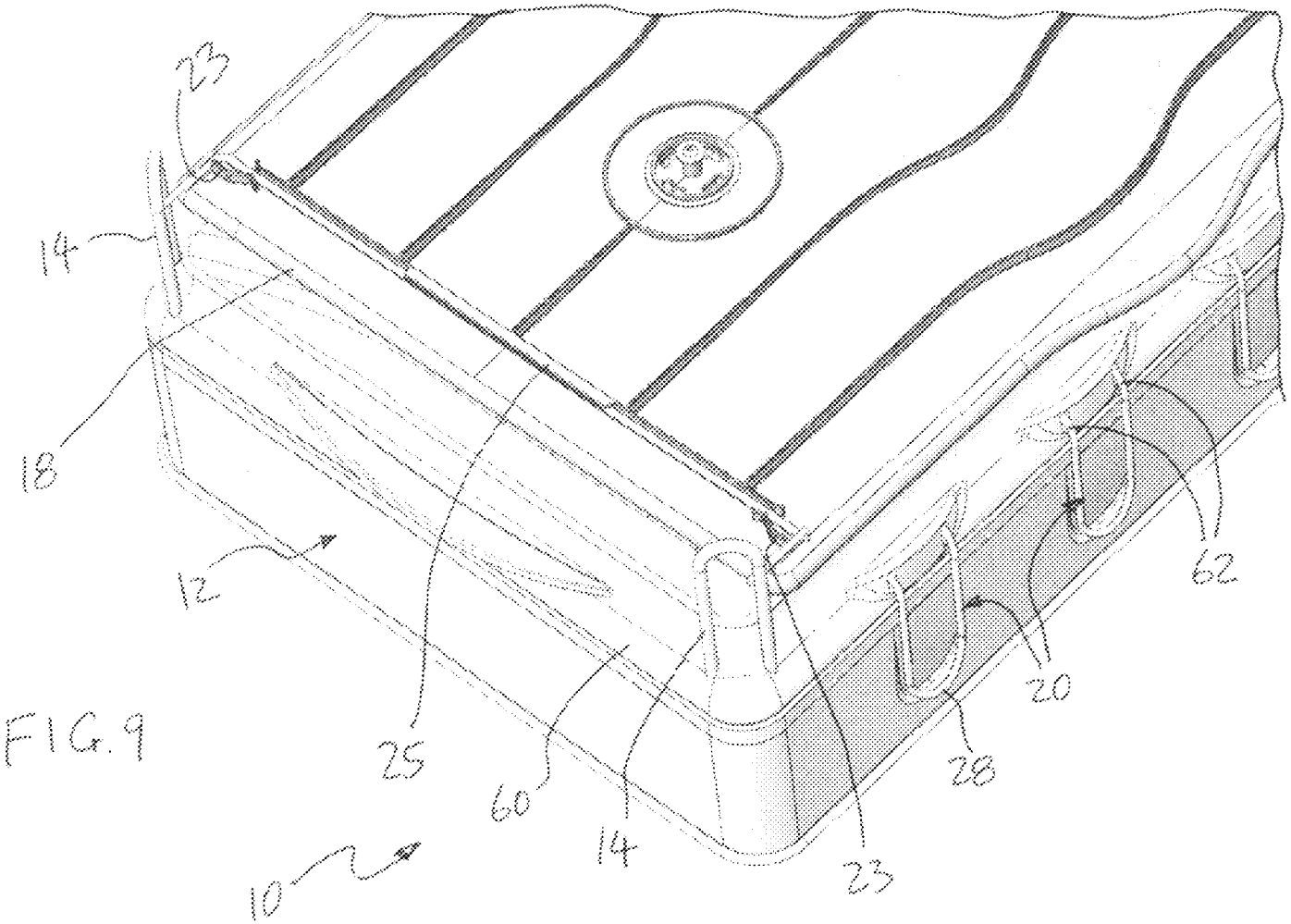
FIG. 9 is a perspective view of the dish rack in FIG. 7, with the slidable drip tray in the retracted position.
Figure 10:
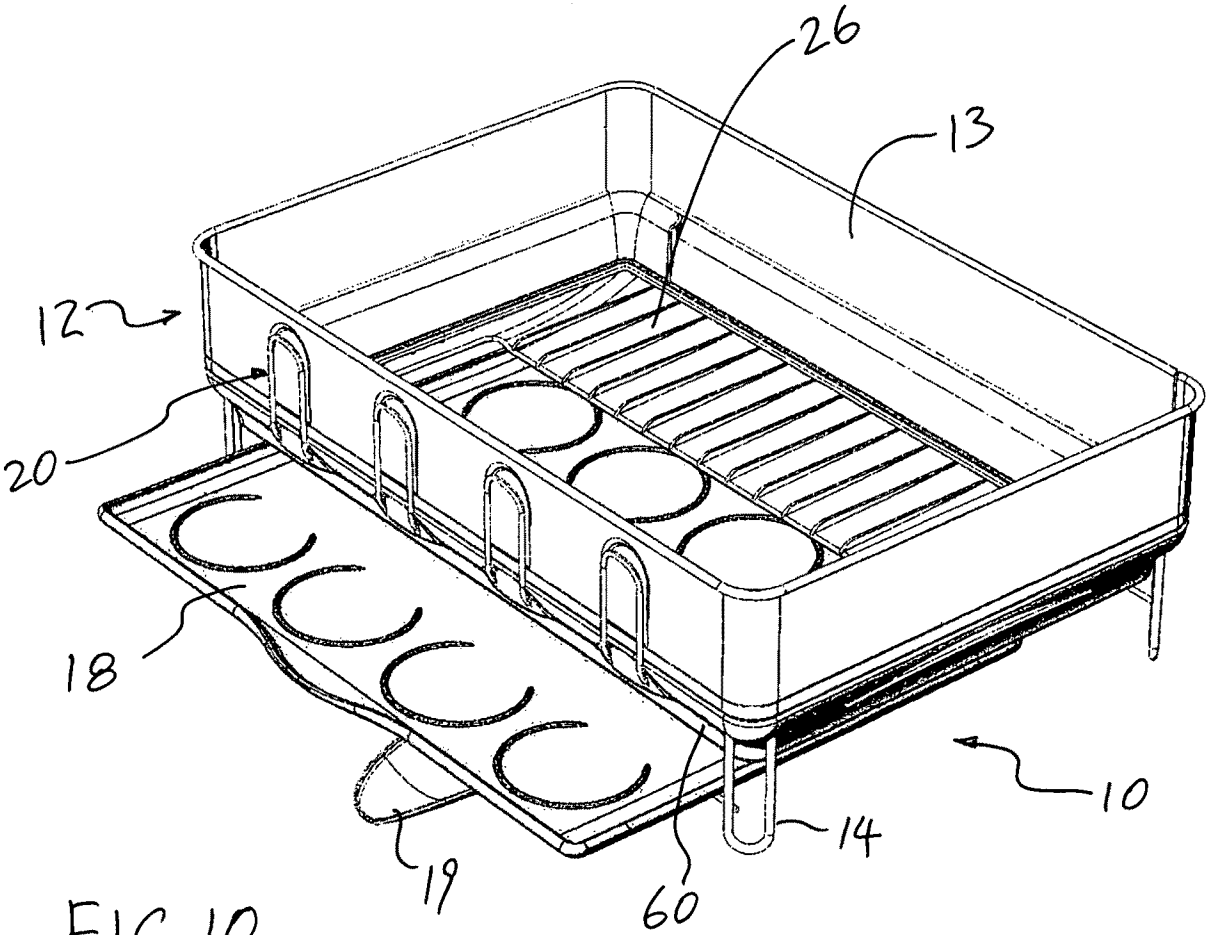
FIG. 10 is a perspective view of the dish rack in FIG. 7, with the slidable drip tray in the extended position.
Figure 11:
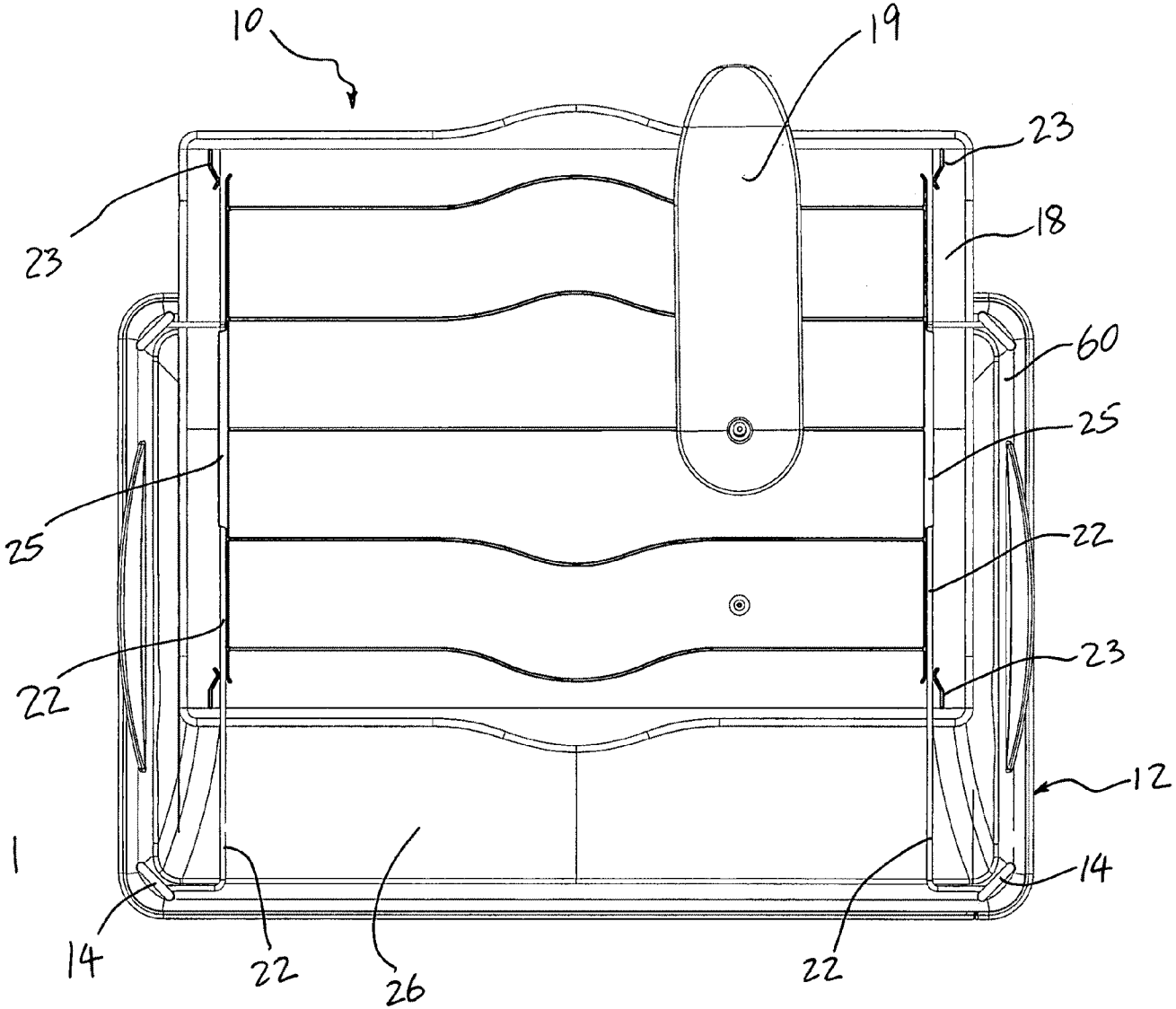
FIG. 11 is a bottom view of the dish rack in FIG. 7, with the slidable drip tray in the extended position.
Figure 12:
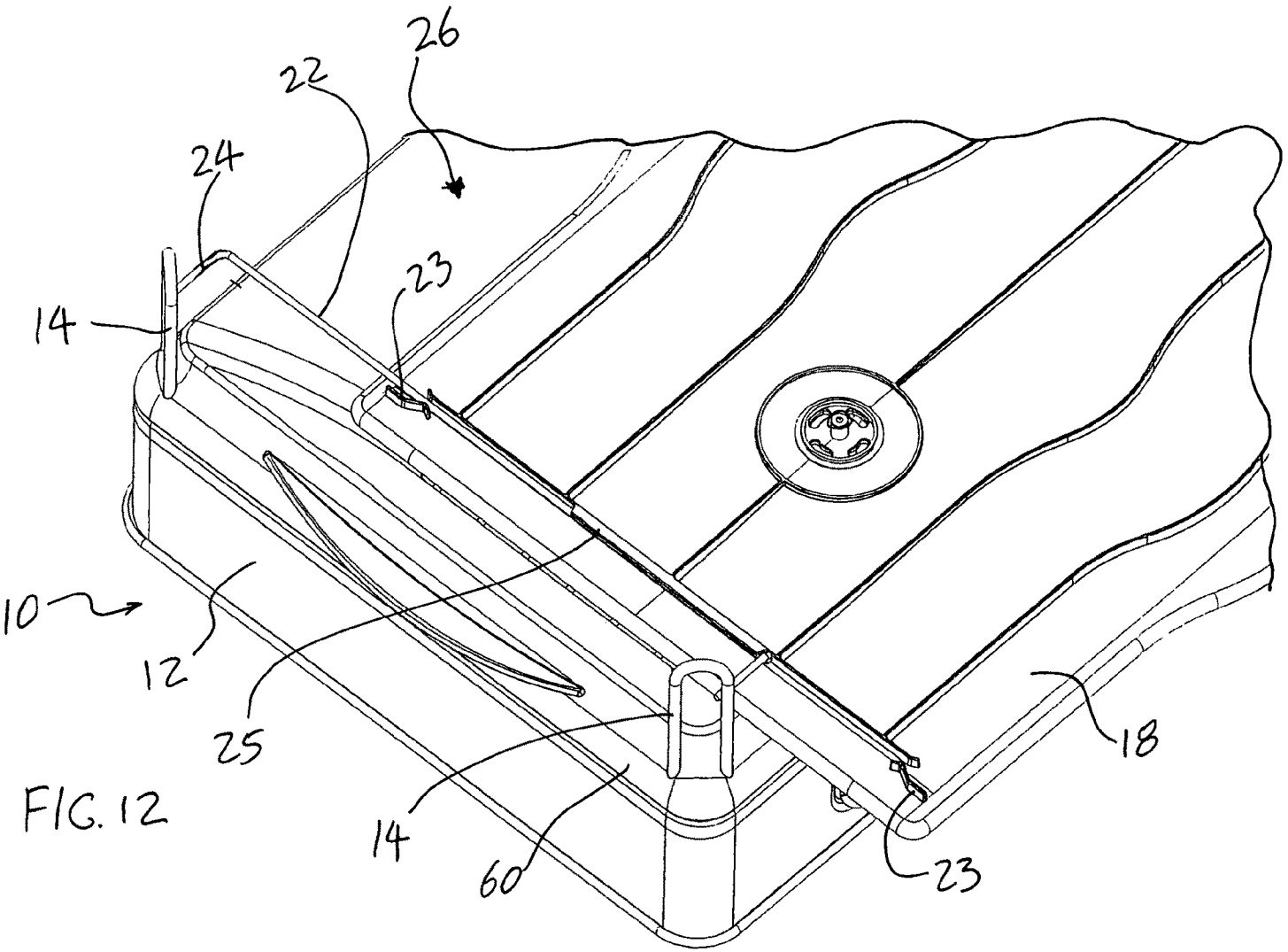
FIG. 12 is a bottom perspective view of the dish rack in FIG. 7, with the slidable drip tray in the extended position.
Figure 13:
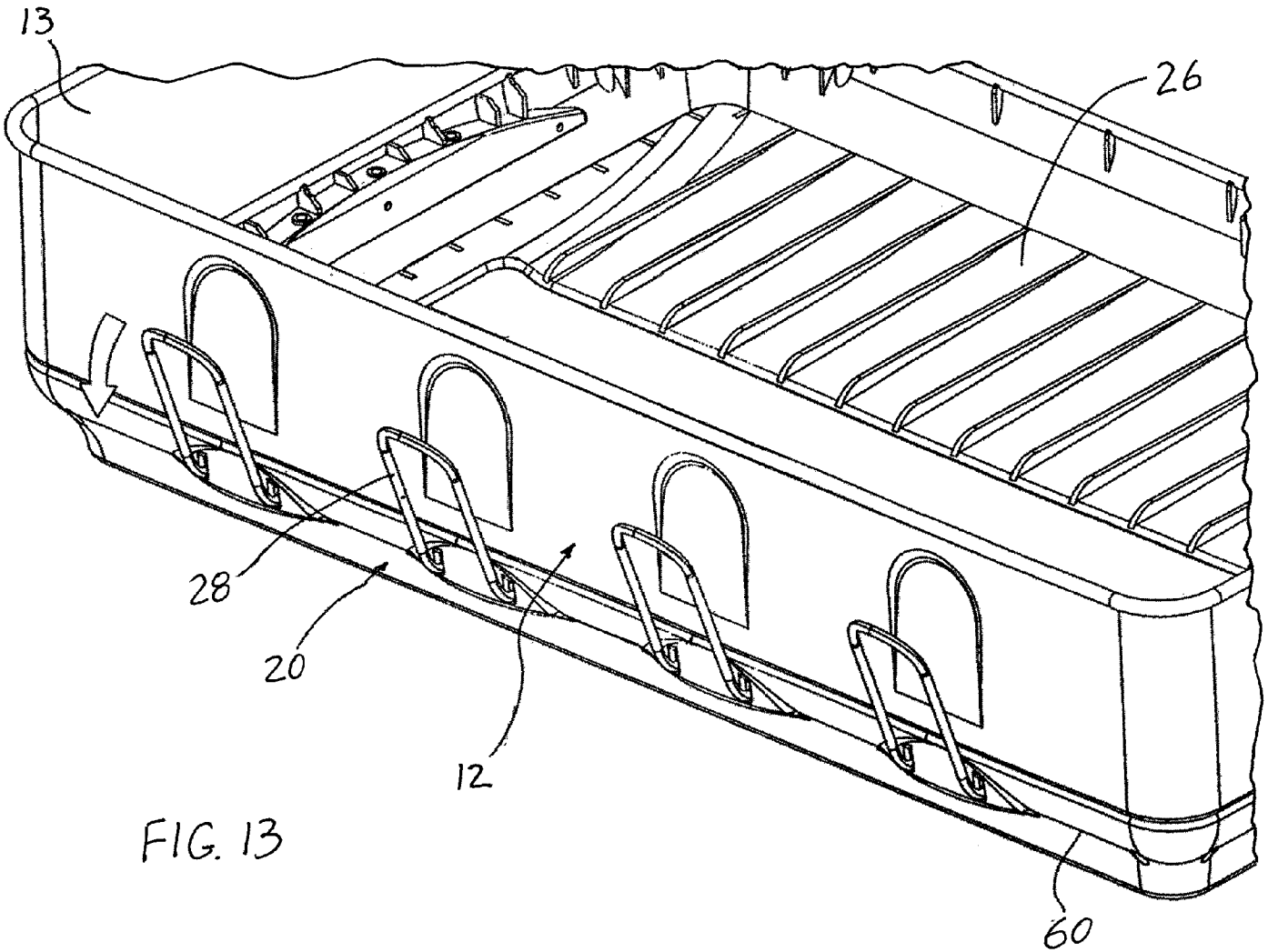
FIG. 13 is an external view showing the cup holders in the extended position, in accordance with one embodiment of the present invention.

In accordance with one aspect of the present invention, the drip catchment area can be extended to increase coverage to catch water drips at beyond the footprint or general perimeter of the dish rack. By sliding the drip tray 18 below the main body of the dish rack to cover an area beyond the walls of the dish rack body, the overall drip area and complementary water catchment area of the dish rack can be effectively extended beyond the regular drip area within the walls 13 of the dish rack. FIG. 7 illustrates a dish rack 10 in accordance with another embodiment of the present invention, with a slight modification to the wire rack 16 as compared to the wire rack in FIG. 1. In FIGS. 7 to 9, the drip tray 18 is shown in the retracted position (FIG. 9 shows the spout removed). The spout 19 is shown rotated to below another side of the body 12, and the cup holders 20 are shown in the retracted, stowed position. FIGS. 10 to 12 illustrate the slidable drip tray 18 in the extended position (FIG. 10 shows the view with the wire rack 16 removed; FIG. 12 shows the spout removed). The drip tray 18 is slidably supported by longitudinal rails 22 provided below two opposing walls. In the embodiment shown, longitudinal tracks are defined by the longitudinal rails 22, which are in the form of a rod or wire supported between two adjacent legs 14. Complementary guides 23 and 25 provided at the bottom side of the drip tray 18 ride slidably against the rails 22. Alternatively, grooves may be defined at the bottom side of the drip tray 18 to receive the rails 22 for sliding motion.

To avoid having the drip tray slide out too much from the dish rack and/or slide in below the dish rack, stops are provided on the bottom surface of the drip tray to limit the range of permissible sliding motion. As more clearly shown in the embodiment of FIG. 12, the rail 22 is supported by the legs 14, with a short bent section 24 at each end of the rail 22. This bent section 24 provides a stop to limit the extent of sliding for the drip tray 18. The bent section 24 engages the center rail guide 25 to limit the drip tray from further sliding on the rail 22. This would be the fully extended position of the drip tray 18.

At one section of the drip area adjacent the base of the side wall 13 (in the illustrated embodiment, along the longer side of the generally rectangular base), an apron 26 in the form of a ramp extends from the base edge of the wall 13 into the drip area, partially covering the drip area. The apron 26 slopes slightly downwardly towards the opposite side of the drip area, thereby draining water falling on the apron 26 towards the center of the drip area. The apron 26 is sized to match the desired fully extended position of the drip tray 18, so that the apron 26 overlaps the drip tray 18 below in its fully extended position (and non-extended position as well), thereby maintaining full coverage in the drip area to catch water dripping from the articles supported by the wire rack 16 above, regardless of the position of the drip tray 18. The user has the option of using the dish rack 10 with the drip tray 18 in the extended or non-extended position.

As can be appreciated, in the extended position, the drip tray 18 provides additional catchment surface area for catching water drips from articles such as cups supported outside of the regular drip area (i.e., the area covered by the wire rack 16) as defined within the side walls 13 of the body 12. The drip tray 18 may be provided with surface textures, such as raised rings (which may be useful to retain item such as cups if they are placed directly on the extended drip tray 18). The drip tray 18 may be contoured to drain water to one edge or to the center of the drip tray 18 (e.g., a sloping contour, v-shaped controur, bowl-shaped contour, ramp, etc.) In the embodiment shown, the drip tray 18 has a drain hole 21 (see FIG. 2) from the top surface of the drip tray 18, leading to a spout 19 at the bottom surface of the drip tray 18 to discharge water. In the illustrated embodiment, the drain spout 19 is rotatably attached to the drip tray, to direct water to a range of positions (e.g. one of two orthogonal sides of the dish rack) to match the environment (e.g., the location of a kitchen sink).

In another aspect of the present invention, pivotal attachments (e.g., cup holders) are provided along the outside of the walls of the base for providing additional support for kitchen articles (e.g., cups, glasses, and small bowls). The pivoted cup supports can be pivoted outward from the wall when needed to extend an area beyond the perimeter of the body to provide supports for holding cups for drying, and they can be pivoted towards and against the wall in a stowed position when not in use. The pivoted cup holders are provided along the side of the base at which the drip tray can slidably extend, so that they can take advantage of the extended drip tray to provide catch area for drips from items supported by the pivotal attachments. The drip tray is extended to catch water drips when the cup holders are pivoted to define the extended cup holding area.

Figure 14:
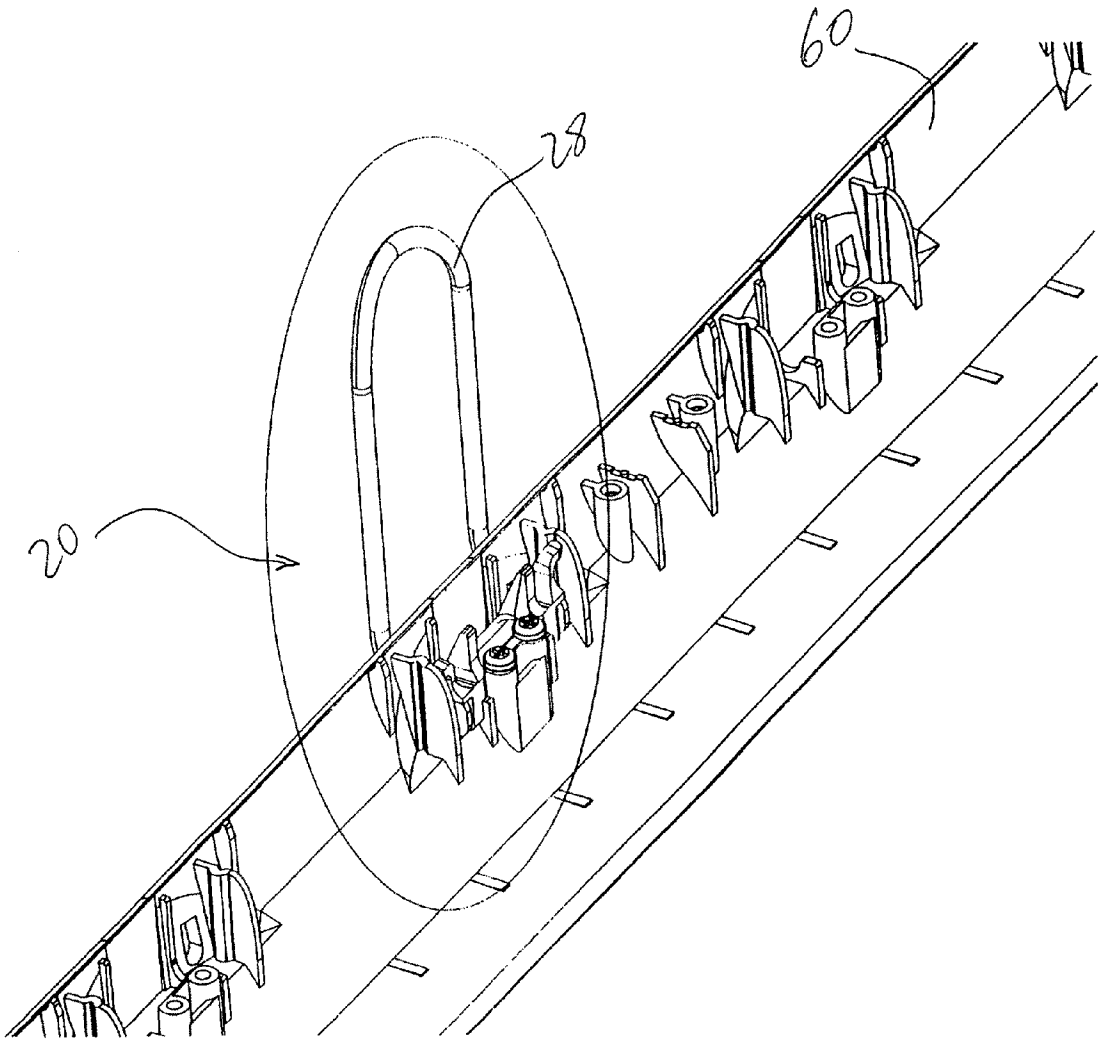
FIG. 14 is an internal view showing a cup holder in the stowed position, in accordance with one embodiment of the present invention.
Figure 15B:
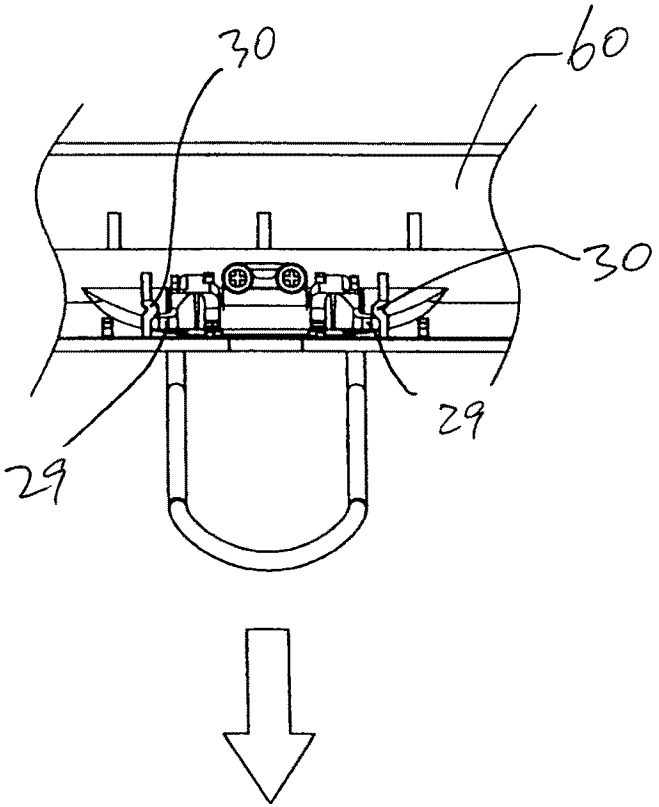
FIG. 15B is a top view of the cup holder pivot mechanism with the cup holder in the extended position.
Figure 15A:
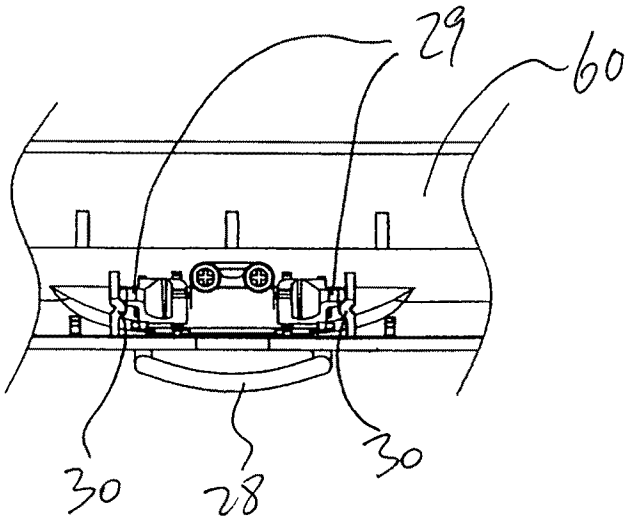
FIG. 15A is a top view of the cup holder pivot mechanism with the cup holder in the stowed position.
Figure 16:
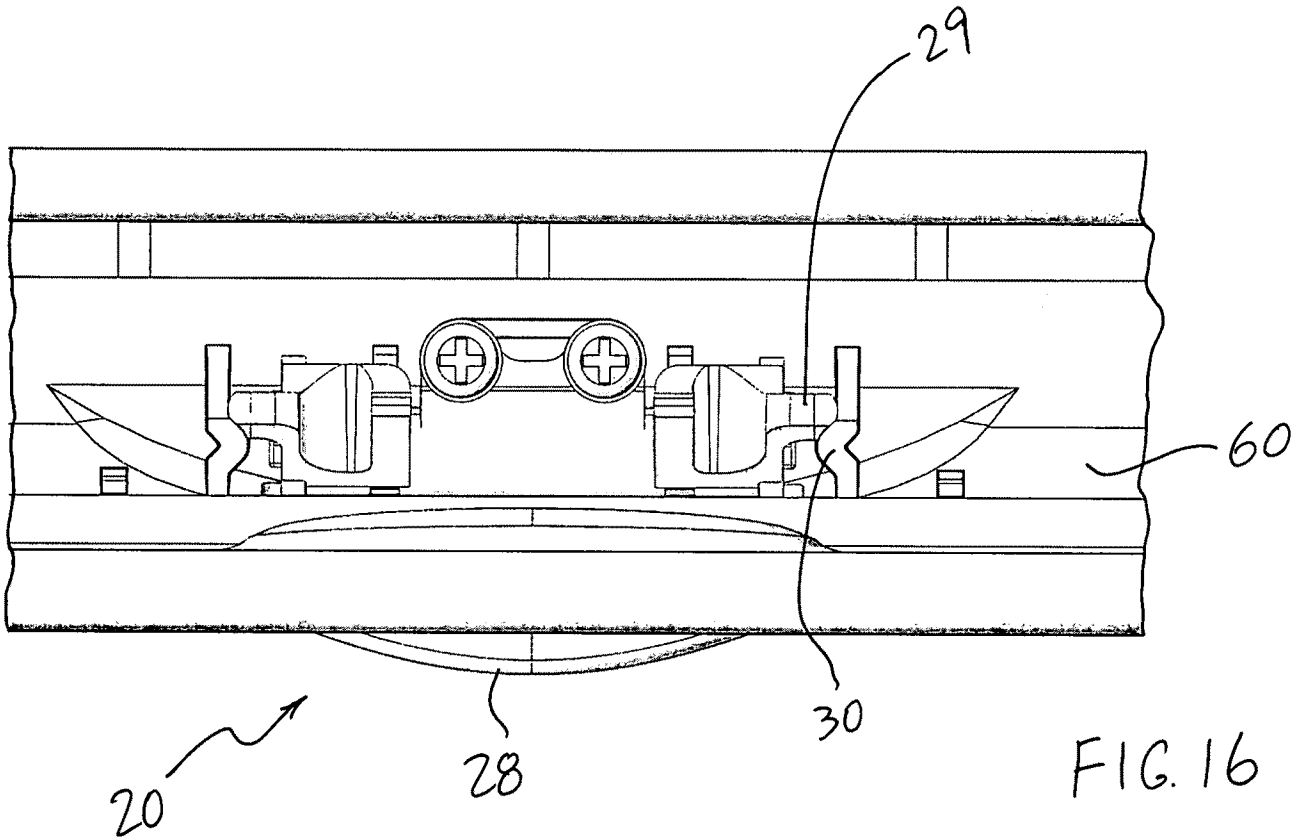
FIG. 16 is a top perspective view showing the cup holder pivot mechanism with the cup holder in the stowed position.
Figure 17:
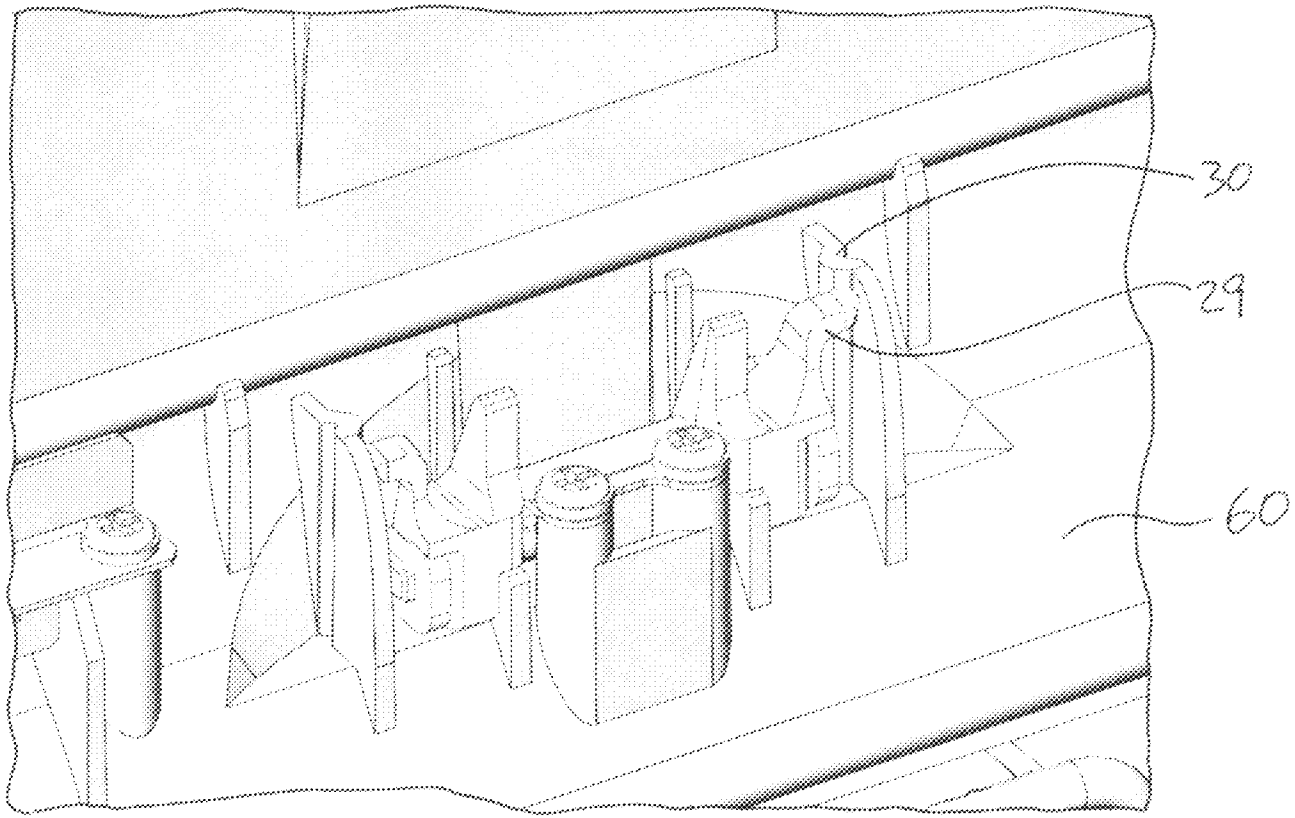
FIG. 17 is a perspective view of the cup holder pivot mechanism with the cup holder in the extended position.

Referring to FIGS. 13 to 17, the cup holder 20 includes a U-shaped loop section 28 shaped and/or contoured to facilitate support of kitchen articles such as cups and small bowls. (FIG. 14 is a view with the side wall 13 removed). The pivoted cup holders may be provided with stops to more securely maintain the loop section 28 in the extended position and the stowed position. As shown in the diagrams, loop section 28 are pivotally supported by the base 60 which supports the wall 13, on the interior side of the wall 13. More specifically, the loop section 28 is pivotally supported by a pivot mechanism supported on the base 60 that includes sideways outward extending tabs 29 that ride over complementary notches 30 when the loop section 28 is pivoted, thereby securing the loop section 28 in the extended position shown in FIG. 15A and the stowed positions shown in FIG. 15B. The base 60 will be described in further detail below.

Figure 18:
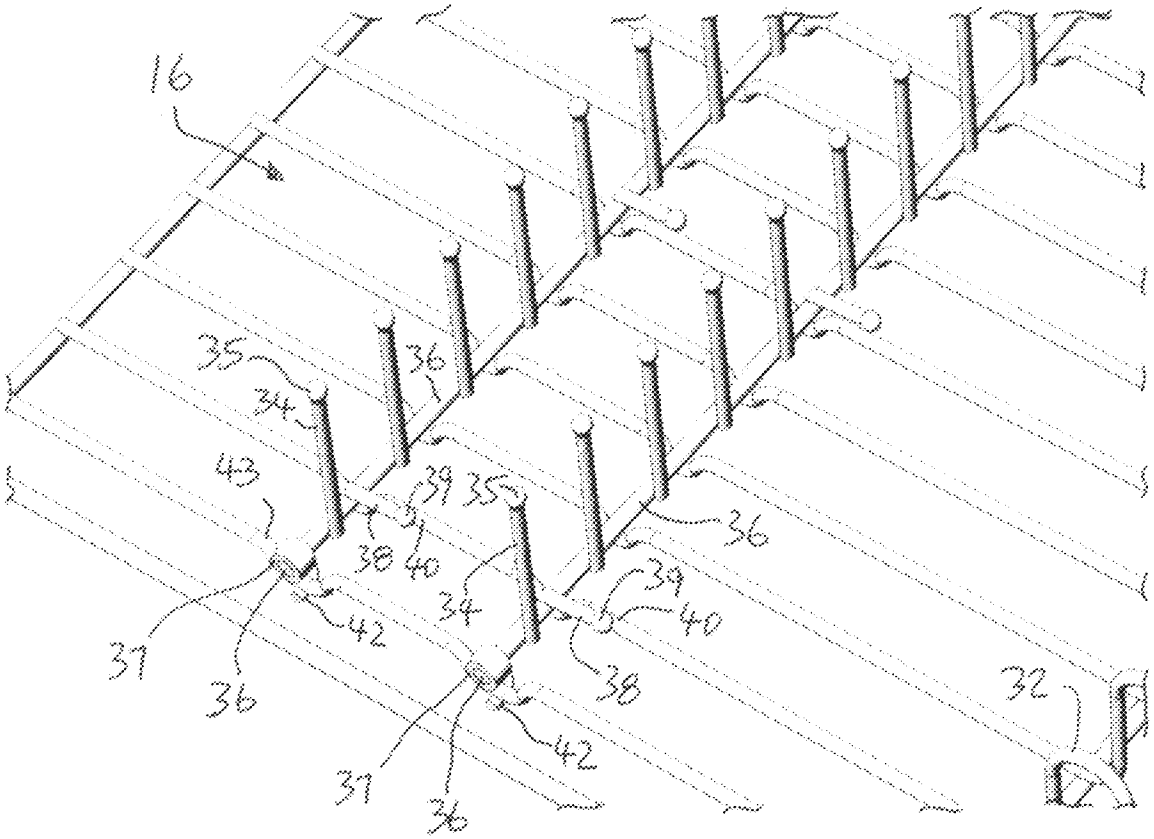
FIG. 18 is a perspective view of a wire rack, with the prongs extended, in accordance with one embodiment of the present invention.
Figure 19:
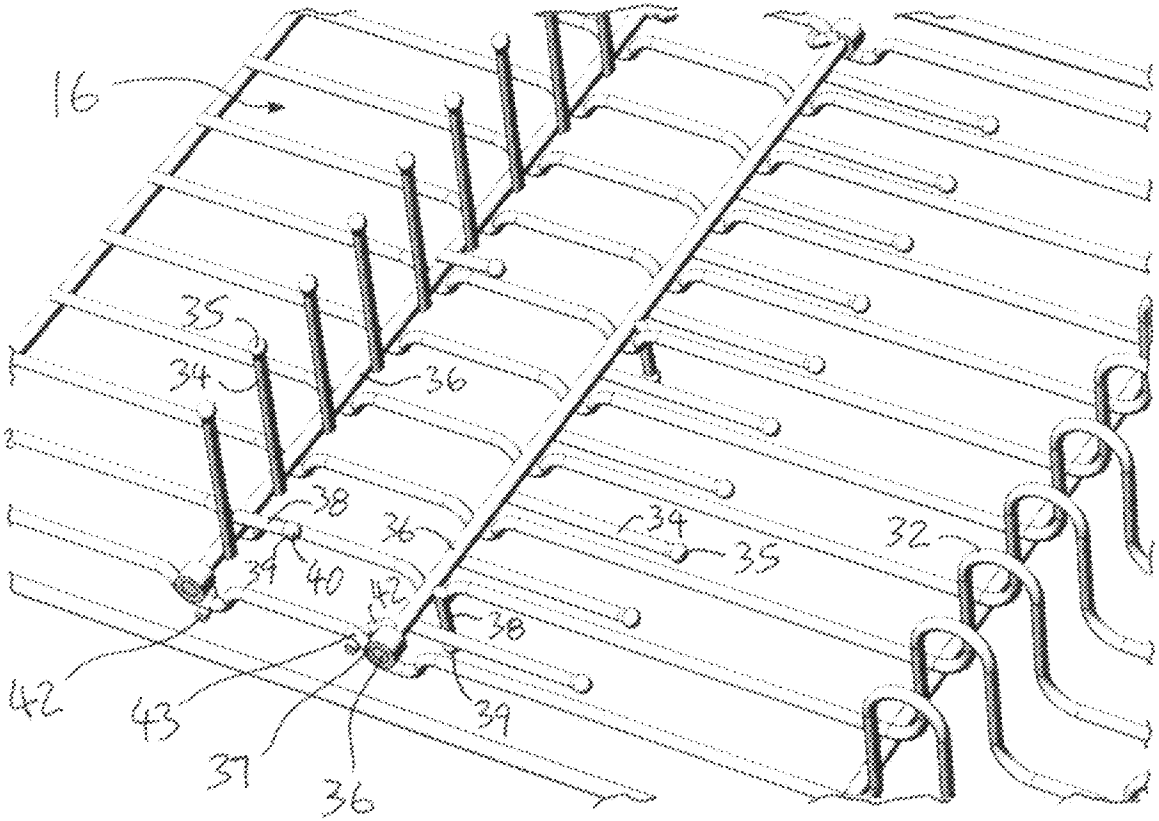
FIG. 19 is a perspective view of a wire rack, with a row of the prongs stowed.
Figure 20:
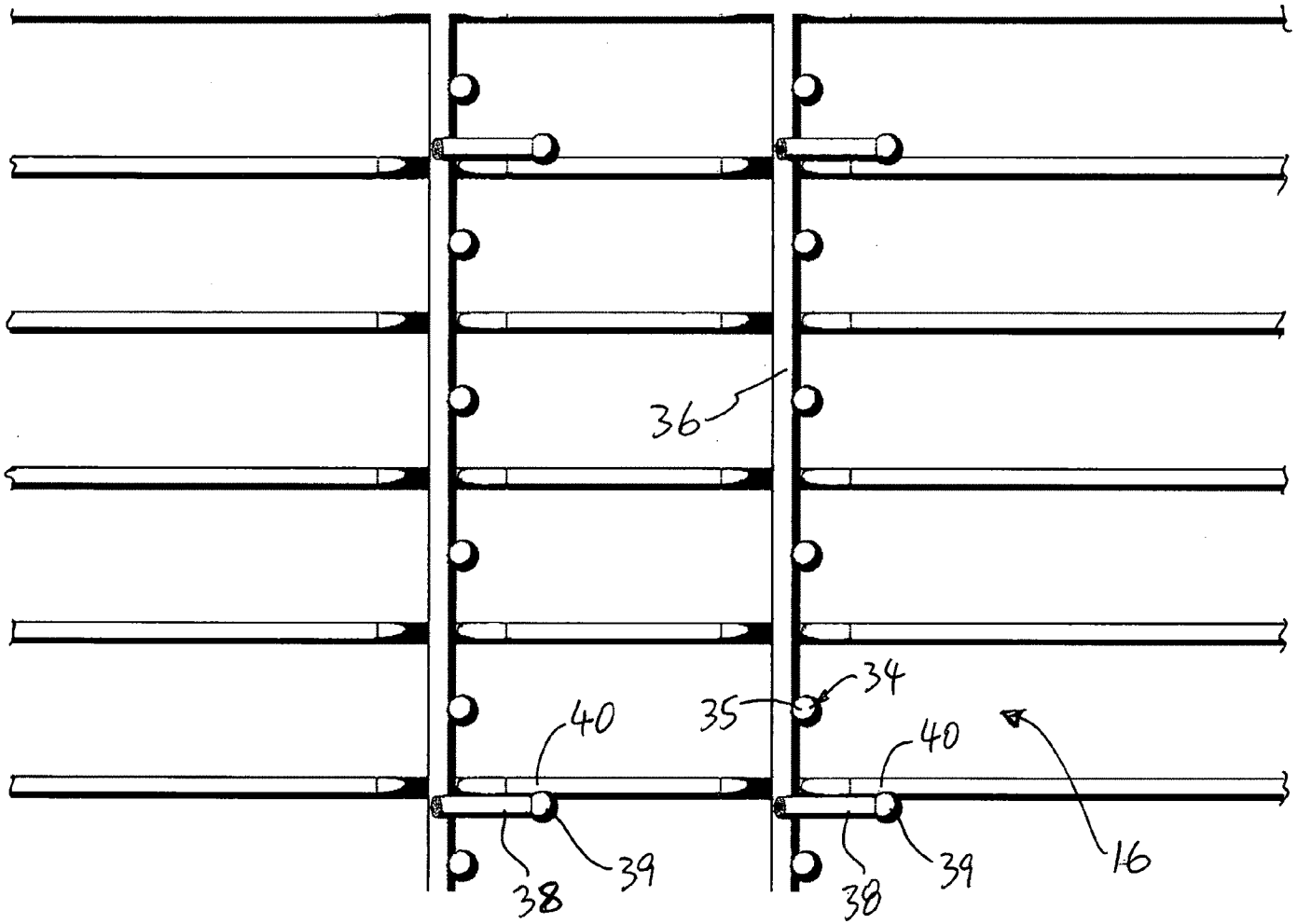
FIG. 20 is a top view of the wire rack, with the prongs extended upright.

In a further aspect of the present invention, within the body of the dish rack, a wire rack, which may be removable or detachable, is provided with pivoted support prongs for configuring the wire rack. Referring to FIGS. 18 to 20, the wire rack 16 includes a grid of wires shaped and/or contoured to facilitate support of kitchen articles such as plates, bowls, cups, etc. For example, part of the wire rack 16 could be shaped and contoured to form raised rack or partitions 32 with slotted openings to facilitate support of plates. To provide additional flexibility, the wire rack 16 is provided with prongs 34 that can be configurable or adjustable by the user. In the illustrated embodiment, one or more rows of interconnected prongs 34 are provided, which can be pivoted from a generally horizontal flip-down stowed position in which the prongs are substantially flush with the general base plane of the wire rack 16 (one of the rows shown in FIG. 19), to a generally vertical flip-up or extended position in which the prongs 34 extends upwards and away from the general base plane of the wire rack 16. Specifically in the illustrated embodiment, the row of interconnected prongs 34 are commonly attached to a horizontal pivot bar, which rod has two ends, each pivotally attached to a ring/cylindrical pivot support 37 to allow rotation of the wire. Each prong 34 terminates in an enlarged end (e.g., a ball shaped end 35).

With the prongs 34 in the flip-down position, large items such as pots and pans may be accommodated and supported on relatively large flat sections of the wire rack 16. With the prongs 34 flipped up in the vertical position, racks are effectively formed to define vertical spaced openings to accommodate plates and cups, for example. Thus, by allowing for adjustable wire racks, the user can easily reconfigure the dish rack to accommodate different kitchen articles.

To secure the prongs 34 in the vertical flip-up position, each row of interconnected prongs 34 are provided with one or more holding prongs 38. The holding prongs 38 are connected to the pivot bar 36 that supports the prongs 38. Each holding prong 38 has an enlarged end (e.g., ball shaped end 39), which is resiliently or spring biased against an adjacent wire section 40 of the wire rack 16 (which wire section 40 and/or holding prong 38 flexes a little laterally) as the row of prongs 34 are flipped from a horizontal position to a vertical position. The ball end 39 of the holding prong 38 is supported against the top of the adjacent wire 40, which holds the row of prongs 34 in the vertical flip-up position.

At the end of the horizontal pivot rod 36 that connects the prongs 34, a stop is provided that provides a limit to the range of rotation of the horizontal pivot rod 36, and thus define the vertical and horizontal limits for the prongs 16. The stop is in the form of a short bent wire section 42, which presses against the adjacent horizontal wire section 43 of the wire rack when the prongs 16 are in the horizontal flip-down position, and presses on the bottom of the ring pivot support 37 (or the wire section below the pivot support 37) when the prongs 34 are in the vertical flip-up position.

The walls 13, cup holder loop section 28, wire rack 16 and legs 14 (and rails 22) of the dish rack 10 may be made of polished, matte finished, coated or painted metal (e.g., polished or brushed stainless steel). Rubber feet (not shown) may be provided to the legs 14 to provide better traction on a support surface. The drip tray may be made of plastic. In yet a further aspect of the present invention, the main body 12 of the dish rack 10 is configured with a substantially continuous, closed, metal side wall that defines the general perimeter or footprint of the dish rack 12 and the internal drip area, which improves ease of cleaning the body as well as the aesthetics of the dish rack. To facilitate pivotal attachment of the cup holder loop section 20 to the metal side wall 13 of the dish rack, a base 60 is provided to couple the pivot mechanism for the cup holders to the metal side wall 13. The base 60 of the dish rack is preferably made of a non-metal material, such as plastic, to facilitate coupling the various components. As illustrated in the drawings (see for example FIG. 9 and FIG. 14), the plastic base 60 facilitates attachment and support of the metal legs 14 (which supports the metal rails 22 for slidable support of the extendable drip tray 18), the metal side walls 13, and the pivot mechanism of cup holder 20. The apron 26 in the drip area may be made an integral part of the base 60 (as illustrated in the drawings), or be a separate part attached to the base. The U-shaped loop section 28 extends on the exterior side of the side wall 13, through openings 62 in the plastic base 60, to be pivotally supported by the pivot mechanism attached on the base 60 at the interior side of the wall 13. FIG. 14 shows the interior side of the base 60. The metal wall 13 is omitted from view in FIG. 14. A trim cover 64 is provided to hide the pivot mechanism and extending around the entire rectangular base edge of the wall 13 (see FIG. 2). The wire rack 16 may be configured to sit against the trim cover 64.

While the invention has been particularly shown and described with reference to the preferred embodiments, it will be understood by those skilled in the art that various changes in form and detail may be made without departing from the spirit, scope, and teaching of the invention. Accordingly, the disclosed invention is to be considered merely as illustrative and limited in scope only as specified in the appended claims.

The invention claimed is:

1. A dish rack, comprising:

a body having walls defining an interior drip area;

a wire rack supported in the drip area, for supporting kitchen articles;

a drip tray slidably supported below the drip area to slid from a first position to a second position;

a spout rotatably connected to a bottom of the drip tray, wherein water drained on the drip tray is directed to drain via the spout, wherein the spout can be swiveled to drain water to a desired direction with respect to the body; and an apron partially covering the drip area, and defining an opening exposing the drip area to the underlying drip tray, wherein the apron is sized to maintain overlap with the drip tray when the drip tray is slid in a direction away from the drip area to the second position.

2. The dish rack as in claim 1, wherein the opening is larger than half of the drip area.

3. The dish rack as in claim 2, wherein the apron partially covers less than half of the drip area.

4. The dish rack as in claim 3, wherein the drip tray is supported to slide away from the drip area by no more than half of area of the drip tray.

5. The dish rack as in claim 1, further comprising cup holders coupled to base of at least one of the walls at outside of the interior drip area, wherein the drip tray extends below the cup holders when slid in a direction away from the drip area to the second position.

6. The dish rack as in claim 5, wherein the cup holders are pivotally coupled to base of the at least one wall.

7. The dish rack as in claim 6, wherein the cup holders pivot from a closed position against an outside surface of the at least one wall, to an extended position away from the outside surface of the at least one wall.

8. The dish rack as in claim 7, wherein the at least one wall is a closed wall.

9. The dish rack as in claim 5, wherein the opening is larger that half of the drip area.

10. The dish rack as in claim 5, wherein the wire rack is provided with pivotable prongs which configure support racks on the wire rack.

11. The dish rack as in claim 10, wherein the opening is larger that half of the drip area.

12. The dish rack as in claim 1, wherein the wire rack is provided with pivotable prongs which configure support racks on the wire rack.

13. A dish rack comprising:

a body having closed walls defining an interior drip area;

a spout rotatably connected to the body, wherein water drains from the body via the spout, wherein the spout can be swiveled to drain water to a desired direction with respect to the body;

cup holders pivotally coupled to base of at least one wall at outside of the interior drip area defined by the closed walls, wherein the cup holders pivot from a closed position against an outside surface of the at least one wall of the closed walls, to an extended position away from the outside surface of the at least one wall of the closed walls;

a drip tray slidably supported below the drip area to slid from a first position to a second position; and an apron partially covering the drip area, and defining an opening exposing the drip area to the underlying drip tray, wherein the apron is sized to maintain overlap of the drip tray when the drip tray is slid in a direction away from the drip area to the second position.

14. The dish rack as in claim 13, wherein the opening is larger than half of the drip area.

15. The dish rack as in claim 13, wherein the drip tray extends below the cup holders when slid in a direction away from the drip area to the second position.

16. The dish rack as in claim 15, wherein the wire rack is provided with pivotable prongs which configure support racks on the wire rack.

17. A dish rack comprising:

a body having closed walls defining an interior drip area;

a spout rotatably connected to the body, wherein water drains from the body via the spout, wherein the spout can be swiveled to drain water to a desired direction with respect to the body;

a wire rack supported in the drip area, wherein the wire rack is provided with pivotable prongs which configure support racks on the wire rack;

a drip tray slidably supported below the drip area from a first position to a second position; and an apron partially covering the drip area, and defining an opening exposing the drip area to the underlying drip tray, wherein the apron is sized to maintain overlap of the drip tray when the drip tray is slid in a direction away from the drip area to the second position.

* * * * *